United States Patent [19]

Gibellina

[11] 4,141,101

[45] Feb. 27, 1979

[54] SELF PROPELLED DRIVEHEAD FOR AUTOMATIC SWIMMING POOL CLEANER

[76] Inventor: Michael C. Gibellina, 8350 E. Cherry Lynn, Scottsdale, Ariz. 85251

[21] Appl. No.: 868,139

[22] Filed: Jan. 9, 1978

[51] Int. Cl.[2] ..... E04H 3/20; B08B 9/08

[52] U.S. Cl. ..... 15/1.7; 210/169

[58] Field of Search ..... 15/1.7; 134/167 R, 168 R; 210/169

[56] References Cited

U.S. PATENT DOCUMENTS

| | | | |
|---|---|---|---|
| 3,170,180 | 2/1965 | Winston et al. | 134/167 R X |
| 3,665,942 | 5/1972 | Moore | 134/167 R |
| 3,718,148 | 2/1973 | Gibellina | 134/167 R |
| 3,758,276 | 9/1973 | Bond et al. | 210/169 X |
| 3,883,366 | 5/1975 | Blumenfeld | 134/167 R X |

*Primary Examiner*—Robert L. Bleutge

*Attorney, Agent, or Firm*—William H. Drummond

[57] ABSTRACT

An improved drivehead for an automatic swimming pool cleaning system includes a circular wheel member mounted for free rotation around a platform member. The platform member carries a water jet nozzle which urges the wheel member into rolling contact with and along the sides of the pool. A flexible water supply hose connects the platform member to a pressurized pool water inlet. The water jet nozzle and supply hose cooperate, when the drivehead encounters an obstruction, to cause the platform member to rotate within the outer wheel member to move the drivehead around the obstruction.

1 Claim, 6 Drawing Figures

SELF PROPELLED DRIVEHEAD FOR AUTOMATIC SWIMMING POOL CLEANER

This invention relates to an automatic swimming pool cleaning system.

More particularly, the invention concerns an improved drivehead for said system.

In another aspect, the invention relates to an improved drivehead of simplified construction which requires only one water jet reaction nozzle to move the drivehead around the periphery of the swimming pool and to cause the drivehead to clear obstructions such as ladders, steps, etc. and other discontinuities in the inner periphery of the pool.

Numerous systems have been devised for automatically cleaning swimming pools. The most commonly used systems employ one or more cleaning hoses which randomly oscillate in response to water ejected from the free ends thereof under pressure. The randomly oscillating hoses and the water ejected therefrom abrade the inner surfaces of the pool to dislodge particulate material and maintain it in suspension in the pool water. The suspended particulate material is then removed from the water by the conventional pool water filtration system.

Typically, the pool cleaning systems which employ flexible cleaning hoses, as described above, utilize some sort of drivehead to move the inner fixed ends of the cleaning hoses to different locations within the pool to effect and insure random contact between the oscillating hoses and the water ejected therefrom with substantially all of the interior surfaces of the pool. Typical examples of such drivehead-motivated cleaning systems are described in the patents to Winston U.S. Pat. No. 3,170,180; Blumenfeld U.S. Pat. No. 3,256,079; Ortega U.S. Pat. No. 3,295,540; Arneson U.S. Pat. No. 3,291,145 and in my own prior U.S. Pat. No. 3,718,148.

The typical systems described in the above mentioned patents vary in degree of complexity from the complex mechanical drive system of Arneson, which employs a water motor-gear train combination, to the relatively more simplified system described in my own U.S. Pat. No. 3,718,148, which utilizes simple water jet reaction nozzles to move the drivehead around the pool.

However, each of these prior art systems involves some degree of mechanical complexity and, to that extent, it would be highly desirable to provide a more simplified drivehead arrangement in order to reduce the maintenance expense and improve overall operating reliability. It would be particularly desirable to provide a drivehead device for an automatic swimming pool system which employs only a single water jet nozzle to furnish the motivation force for moving the drivehead around the sides of the pool and which, nevertheless, is adapted to prevent the drivehead from stalling when it encounters obstructions or discontinuities in the walls of the pool such as those presented by ladders, steps, skimmers, etc.

It is therefore an object of the present invention to provide an improved drivehead for an automatic swimming pool cleaning system of the type employing randomly oscillating cleaning hoses.

Yet another object of the invention is to provide a drivehead of the type described which is of simplified and relatively inexpensive construction.

Still another object of the invention is to provide a drivehead for such a system which requires a minimum amount of maintenance and which operates reliably and which is "self freeing" when it encounters such obstruction.

These and other, further, and more specific objects and advantages of the invention will be apparent to those skilled in the art from the following detailed description thereof, taken in conjunction with the drawings, in which.

Figure 2:
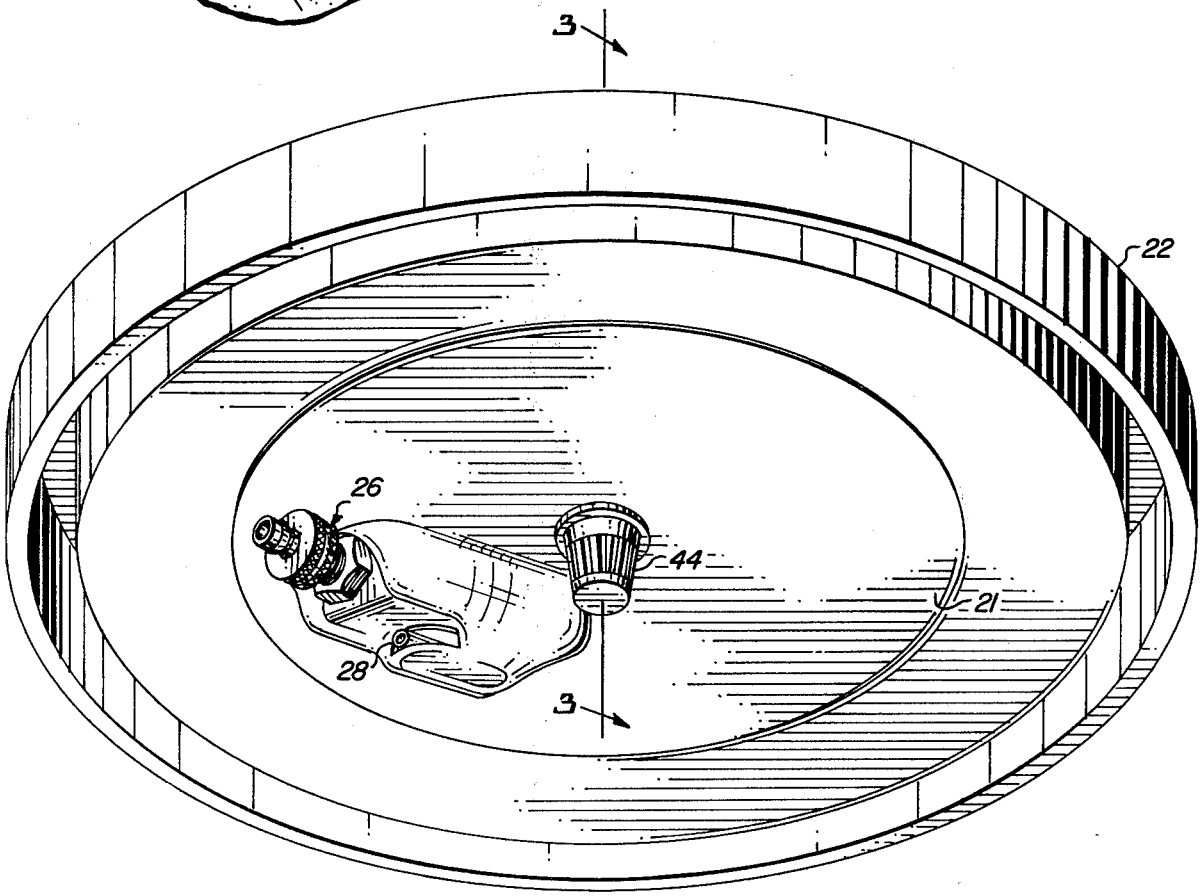
FIG. 2 is a perspective view of the drivehead of the present invention, viewed from below.
Figure 3A:
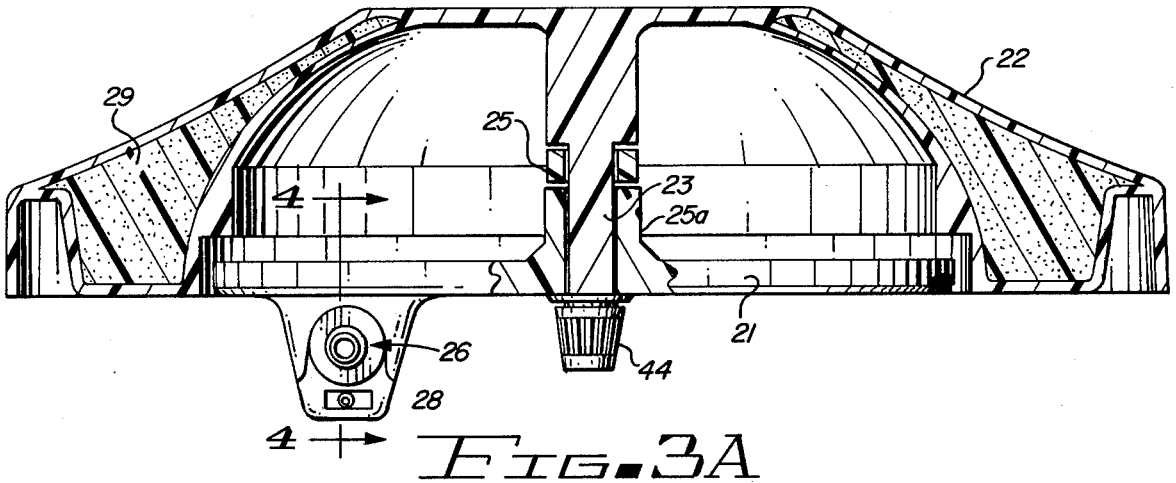
Figure 4:
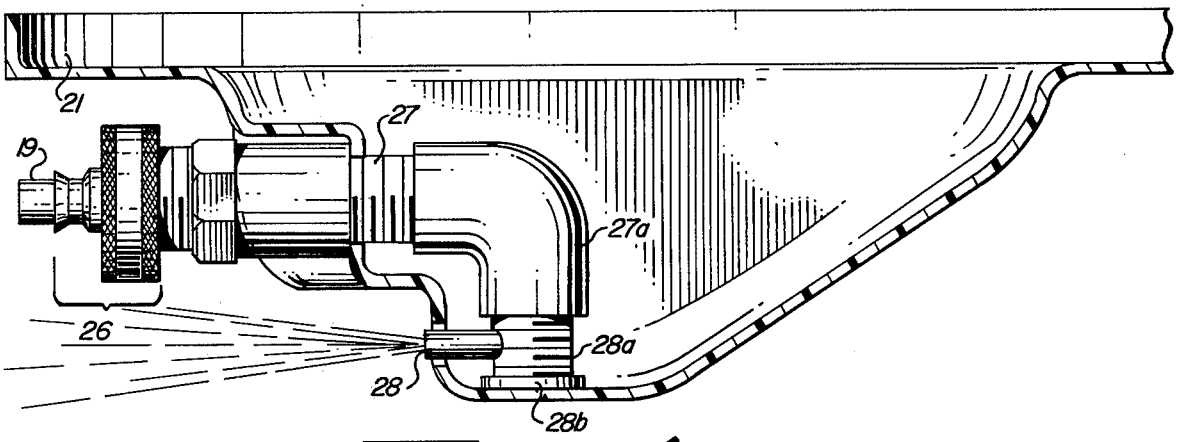
Figure 5:
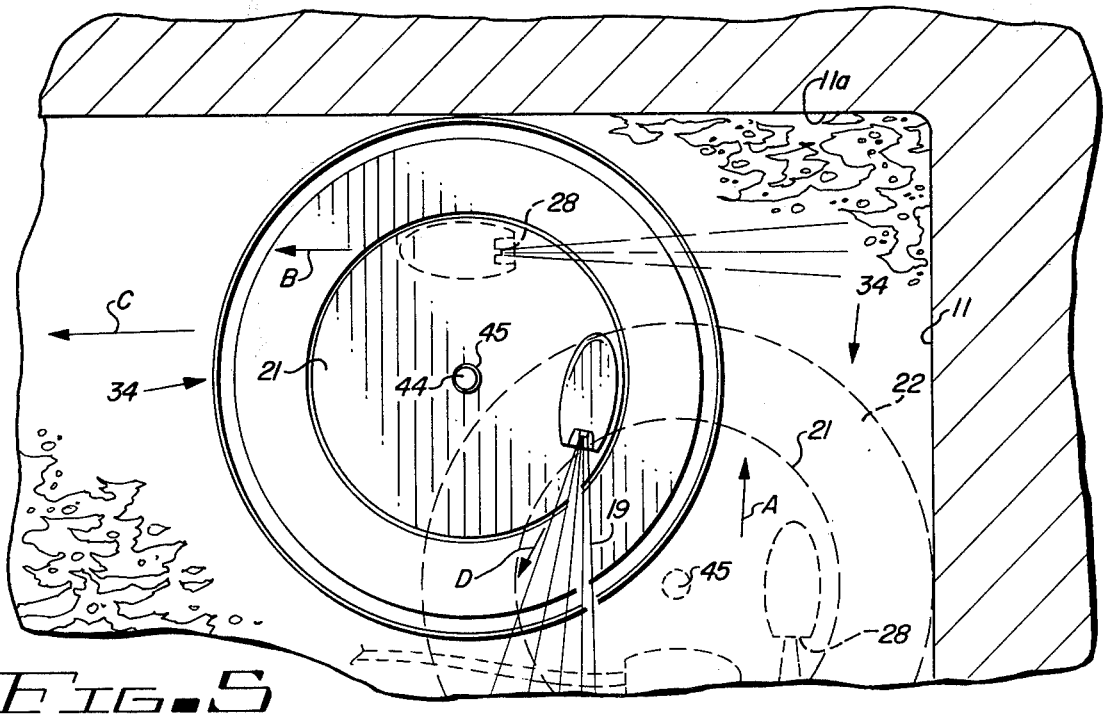
Figure 3B:
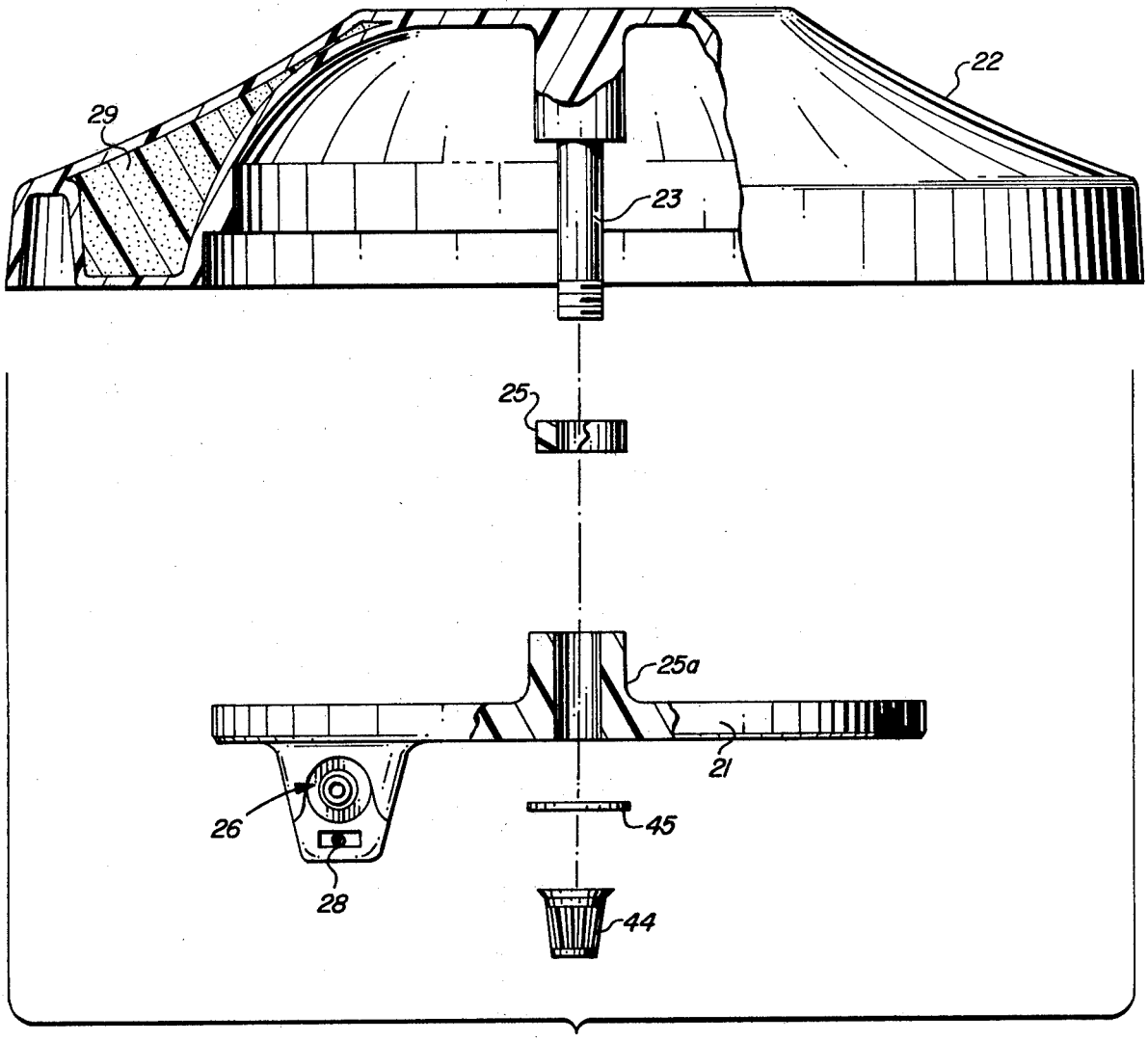

FIGS. 3*a* and 3*b* are sectional views of the drivehead of FIG. 2 taken along section line 3–3 thereof;

FIG. 4 is a sectional view of the platform member portion of the drivehead of FIG. 3 taken along section line 4—4 thereof; and FIG. 5 is a bottom view of the drivehead of FIGS. 1–4, shown floating in a swimming pool, and attached to a water supply hose.

Briefly, in accordance with the invention, I provide a drivehead for a typical automatic swimming pool cleaning system. The typical system includes at least one elongate flexible cleaning hose having inner fixed end and an outer free end, means for supplying water under pressure to the inner fixed end of the cleaning hose to cause the hose to randomly oscillate, and drivehead means operatively associated with the cleaning hose to move the inner water receiving end thereof to different locations within the pool. The oscillating hoses abrade the inner surfaces of the swimming pool to dislodge particulate material therefrom and to maintain the particulate material in suspension in the pool water for removal by a filtration system. The drivehead moves the inner ends of the cleaning hoses to different locations in the pool to insure random contact between the oscillating hoses and the water ejected therefrom with substantially all of the interior surfaces of the pool.

The improved drivehead of the present invention comprises a horizontal platform member, a circular wheel member mounted horizontally for free rotation on the platform member, a water jet nozzle carried by the platform member and a means for connecting a flexible water supply hose to the nozzle for effecting fluid communication between the nozzle and a source of water under pressure. The periphery of the wheel member extends laterally beyond the periphery of the platform member. The reaction force of the water jet nozzle urges the wheel member into rolling contact with and along the sides of the pool. The water jet nozzle and the supply hose cooperate, when the drivehead encounters an obstruction, to cause the platform member to rotate within the circular wheel member, to move the drivehead around the obstruction and continue its normal movement in rolling contact with and along the sides of the pool. When the drivehead encounters an obstruction and is momentarily stopped, the platform member rotates around its axis until the jet provides directional force to move the drivehead around the obstruction.

Figure 1:
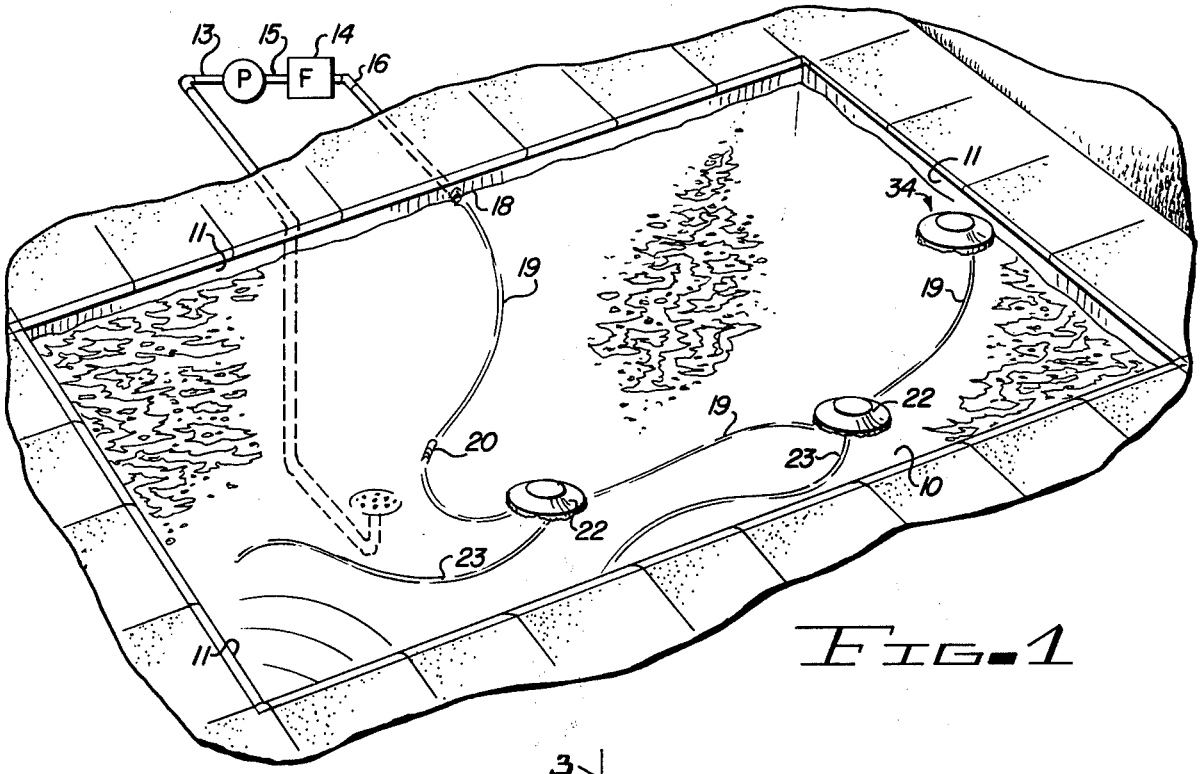
FIG. 1 is a perspective view of a swimming pool with a typical "cleaning hose"-type automatic cleaning system installed therein, which utilizes the improved drivehead of the present invention.

Turning now to the drawings, FIG. 1 depicts a conventional swimming pool, generally indicated by reference character 10, which includes inner sides 11, side walls and bottom (not shown) defining a large water type reservoir. The water system of the pool includes a pump 12, the suction side 13 of which withdraws water from a pool filter system 14 which filters pool water 15 containing suspended particulate material. The discharge 16 of the pump 12 returns water under pressure through a fixed conduit 17 to a hose connection 18 located in a side wall 11 of the pool 10. A flexible hose 19 provided with suitable swivel connections 20 delivers water from the pump discharge connection 18 through the flexible hose 19 to one or more assemblies 21 consisting of a float member 22 and depending scouring hoses 23 which function in the manner generally described above to dislodge and maintain particulate matter in suspension in the pool water 24.

The flexible supply hose 19 is connected at its outer end to a drivehead assembly 34 which will be described in greater detail below. The drivehead 34 serves to propel the float members 22 and the depending scouring hoses 23 to random locations within the pool so as to insure that the scouring hoses 23, over a period of time, effect random contact with substantially all of the interior surfaces of the pool.

The drivehead 24 of FIG. 1 is depicted in greater detail in FIGS. 2–4, in which like reference characters identify common elements in the several views. The drivehead consists of a horizontally disposed platform member 21. A hollow circular wheel member 22 is provided with a depending vertical axle 23 threadedly secured on its lower end by means of a hand tightened nut 44. The axle 23 is journaled for free rotation in an upstanding bearing 25*a* integrally formed with the platform member 21. Proper vertical spacing of the wheel member 22 above the platform member 21 is maintained by the spacer bushing 25.

The platform member 21 is provided with a threaded hose connection assembly, generally indicated by reference character 26, for attaching the flexible supply hose 19 to a conduit 27 which supplies water under pressure to a nozzle 28. The nozzle 28 is mounted upon a threaded nipple 28*a* which is rotatably engaged with threads in the elbow portion 27*a* of the conduit 27 and threads in the upstanding boss 28*b* such that the angular orientation of the nozzle 28 with respect to the center line of the conduit 27 can be varied to adjust the direction of the stream of water issuing from the jet 28 to compensate for various lengths and weights of the flexible supply hose 19. The hollow cavity 29 formed in the circular wheel member 22 provides sufficient buoyancy to cause the entire assembly 34 to float upon the surface of the pool water 24.

The operation of the drivehead 34 is shown schematically in FIG. 5. As the drivehead 34, indicated by dash lines, moves in the direction of the arrow A along the side wall 11 of the pool, the outer circular wheel member 22 rotates freely on its axis 45 around the platform member 21, propelled by the reaction to the pressurized water exiting the water jet nozzle 28.

As the outer periphery of the wheel member 22 contacts the next adjacent side wall 11*a* of the pool, platform member 21 rotates upon the axis 45 to the position shown by the solid lines with the water jet issuing from the nozzle 28 now pointed in the direction of the arrow B. The entire assembly is then urged along the side wall 11*a* of the pool in the direction of the arrow C. Thus, as will be appreciated by those skilled in the art, the forces acting upon the drivehead 34 are the thrust of the water jet 28 in the direction of the arrow B and the drag provided by the existence of the supply hose 19 in the direction of the arrow B result in a resultant force in the direction of the arrow C tending to urge the entire assembly 34 against the side wall 11*a* and propel it along the side wall in the direction of the arrow C. By utilizing the forces generated by the drag of the supply hose 19 and the reaction force generated by the water issuing from the nozzle 28, the entire assembly is urged against the side walls of the pool and, when it encounters an obstruction or discontinuity in the side walls of the pool, the platform 21 rotates within the free-wheeling wheel member 22 until the vector result of the forces causes the entire assembly to rotate around and clear the obstruction.

As will be apparent to those skilled in the art, the above described automatic swimming pool cleaner drivehead is clearly distinguishable from the prior art in several functional and structural respects. It has only one moving part, is totally water powered, no booster pump is required, and the pressurized water supply entering the apparatus does not contact any bearings or other surfaces which have relative movement during operation, such that grit or other foreign matter in the water supply does not interfere with the operation of the single moving part of the claimed invention.

Having described my invention in such clear and concise terms as to enable those skilled in the art to understand and practice it and having identified the presently preferred embodiment thereof, I claim:

1. A drivehead for an automatic swimming pool cleaning system, which system includes, at least one elongate flexible cleaning hose having an inner fixed end and an outer free end, means for supplying water under pressure to the inner fixed end of said cleaning hose to cause said hose to randomly oscillate, thereby abrading the inner surfaces of the swimming pool to dislodge particulate material therefrom and maintain said particulate material in suspension in the pool water for removal by the pool water filtration system, and drivehead means operatively associated with said cleaning hose to move the inner water receiving end thereof to different locations within said pool to effect random contact between said oscillating hose and substantially all of the interior surfaces of said pool, said drivehead comprising:

(a) a horizontal platform member;

(b) a circular wheel member mounted horizontally for free rotation on said platform member, the periphery of said wheel member extending laterally beyond the periphery of said platform member;

(c) a water jet nozzle carried by said platform member, disposed to eject a stream of water therethrough, the reaction force of which urges said wheel member into rolling contact with and along the sides of said pool; and (d) means for connecting a flexible water supply hose to said nozzle for effecting fluid communication between said nozzle and a source of water under pressure, said water jet nozzle and said supply hose cooperating, when said drivehead encounters an obstruction, to cause said platform member to rotate within said circular wheel member, to move said drivehead around the obstruction and continue its normal movement in rolling contact with and along the sides of said pool.

* * * * *